US005826924A

United States Patent [19]

Huang

[11] Patent Number: 5,826,924

[45] Date of Patent: Oct. 27, 1998

[54] LOCK ASSEMBLY WITH EMERGENT FORCIBLE UNLATCHING FROM OUTSIDE

[75] Inventor: Chao-Ming Huang, Kaohsiung Hsien, Taiwan

[73] Assignee: Taiwan Fu Hsing Industry Co., Ltd, Taiwan

[21] Appl. No.: 900,287

[22] Filed: Jul. 25, 1997

[51] Int. Cl.[6] ..... E05B 13/00

[52] U.S. Cl. ..... 292/359; 292/169.14; 70/468; 70/483

[58] Field of Search ..... 70/467, 468, 483–485, 70/150, 153; 292/359, 169.14

[56] References Cited

U.S. PATENT DOCUMENTS

| | | | |
|---|---|---|---|
| 1,904,210 | 4/1933 | Eichel, Jr. . | |
| 2,541,723 | 2/1951 | Shaw et al. | 70/485 |
| 2,800,347 | 7/1957 | Wardwell, Jr. | 70/483 |
| 3,550,411 | 12/1970 | Neary et al. . | |
| 4,142,748 | 3/1979 | Hook | 70/486 |
| 4,640,112 | 2/1987 | Kambic . | |
| 4,869,083 | 9/1989 | DeMarseilles et al. . | |
| 5,067,758 | 11/1991 | Fann et al. . | |
| 5,149,155 | 9/1992 | Caeti et al. . | |
| 5,190,327 | 3/1993 | Lin . | |
| 5,265,924 | 11/1993 | Kim . | |
| 5,286,074 | 2/1994 | Lin . | |
| 5,481,890 | 1/1996 | Millman . | |
| 5,505,508 | 4/1996 | Kuo . | |
| 5,566,996 | 10/1996 | Massey et al. . | |

FOREIGN PATENT DOCUMENTS

| | | |
|---|---|---|
| 169660 | 9/1991 | Taiwan . |

*Primary Examiner*—Steven N. Meyers
*Assistant Examiner*—Tuyet-Phuong Pham
*Attorney, Agent, or Firm*—Bacon & Thomas

[57] ABSTRACT

A lock assembly includes an inner handle assembly having a first control plate and an inner handle, an outer handle assembly having a latching plate, and a latch assembly. The lock assembly is shifted from an unlatched status to a latched status upon operation of the first control plate, and rotation of either of the inner handle and the latching plate may unlatch the lock assembly.

5 Claims, 6 Drawing Sheets

LOCK ASSEMBLY WITH EMERGENT FORCIBLE UNLATCHING FROM OUTSIDE

BACKGROUND OF THE INVENTION

1. Field of the Invention

The present invention relates to a lock assembly which can be unlatched from outside when in emergency.

2. Description of the Related Art

A wide variety of locks have heretofore been provided, examples of which are U.S. Pat. No. 1,904,210 to Eichel, Jr.; U.S. Pat. No. 3,550,411 to Neary et al.; U.S. Pat. No. 4,640,112 to Kambic; U.S. Pat. No. 4,869,083 to DeMarseilles et al.; U.S. Pat. No. 5,067,758 to Fan et al.; U.S. Pat. No. 5,149,155 to Caeti et al.; U.S. Pat. No. 5,190,327 to Lin; U.S. Pat. No. 5,265,924 to Kim; U.S. Pat. No. 5,286,074 to Lin; U.S. Pat. No. 5,481,890 to Millman; and U.S. Pat. No. 5,566,996 to Massey et al. Conventionally, the locks are normally locked from inside and thus cannot be unlatched from outside without the proper key. However, when in emergency, e.g., if one falls in the bathroom, nobody can be of help immediately. The present invention is intended to provide an improved lock assembly to solve this problem.

SUMMARY OF THE INVENTION

It is an object of the present invention to provide a lock assembly which can be forcibly unlatched from outside when in emergency.

A lock assembly in accordance with the present invention comprises:

an inner handle assembly comprising:

a first base plate secured to an inner side of a door plate, a first handle mounted to the first base plate to rotate therewith, a first mounting plate secured to the first base plate and including a first slot means defined therein, a returning plate, a first control plate slidably engaged with the first slot means of the first mounting plate and including a first toothed structure, a linking plate mounted to the first control plate and including a second toothed structure to engage with the first toothed structure, wherein rotational movement of the linking plate along the first slot means causes rectilinear movement of the first control plate and wherein rectilinear movement of the first control plate along the first slot means causes rotational movement of the linking plate, thereby causing the first control plate to move between a first latched position which engages with the returning plate and a second unlatched position which disengages from the returning plate, a first axle rod extended through the returning plate, the first mounting plate, and the first base plate to rotate therewith and including a first end secured to the first handle to rotate therewith and a second end, an outer handle assembly comprising:

a second base plate adapted to be secured to an outer side of the door plate, a second handle mounted to the second base plate to rotate therewith, a second mounting plate secured to the second base plate and including a second slot means defined therein, a restraining plate including a third toothed structure, a second control plate slidably engaged with the second slot means of the second mounting plate and including a fourth toothed structure to releasably engage with the third toothed structure and a fifth tooted structure, a latching plate including a first end mounted to the second control plate and including a sixth toothed structure to engage with the fifth toothed structure and a second operative end, wherein rotational movement of the latching plate causes rectilinear movement of the second control plate, thereby causing the second control plate to move between a first latched position in which the third toothed structure engages with the fourth toothed structure to prevent rotational movement of the restraining plate and a second unlatched position in which the third toothed structure disengages from the fourth toothed structure to allow rotational movement of the restraining plate, a second axle rod extended through the restraining plate, the second mounting plate, and the second base plate to rotate therewith and including a first end secured to the second handle to rotate therewith and a second end, a latch assembly including a latch actuatable upon rotation of the first axle rod and the second axle rod, and a linking rod extended through the linking plate, the first mounting plate, the first base plate, the latching assembly, the latching plate, the second mounting plate, and the second base plate to rotate therewith, whereby when the first control plate is moved from the first latched position to the second unlatched position thereof, the second control plate is moved to the second unlatched position thereof and the second handle is not rotatable, and when either one of the first handle and the latching plate is rotated, the first control plate and the second control plate are moved to the first latched positions thereof.

In a preferred embodiment of the invention, each of the first control plate and the second control plate includes two notches defined in a lateral sides thereof, and further includes an elastic means having a first end securely attached to the associated control plate and a second end engaged in one of the two notches to retain the control plate in position.

Preferably, the first control plate of the inner handle assembly includes a grasp section for user's grasp to move between the first latched position and the second unlatched position thereof. Preferably, the returning plate includes a rectilinear side to engage with the first control plate, and the restraining plate includes a rectilinear section to engage with the second control plate.

Other objects, advantages, and novel features of the invention will become more apparent from the following detailed description when taken in conjunction with the accompanying drawings.

DESCRIPTION OF THE PREFERRED EMBODIMENTS

Figure 1:
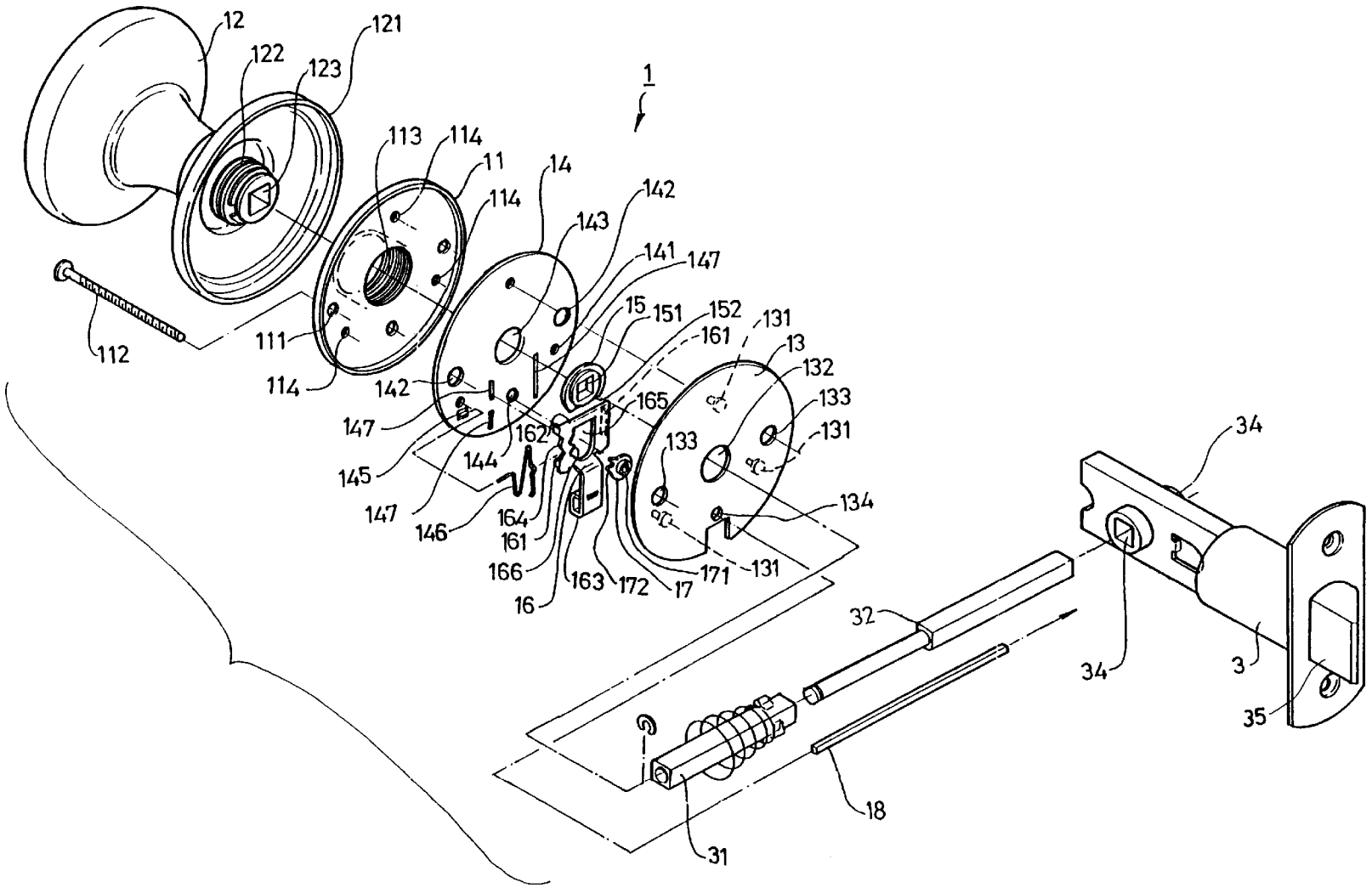
FIG. 1 is an exploded perspective view of an inner handle assembly and a latching assembly of a lock assembly in accordance with the present invention.
Figure 2:
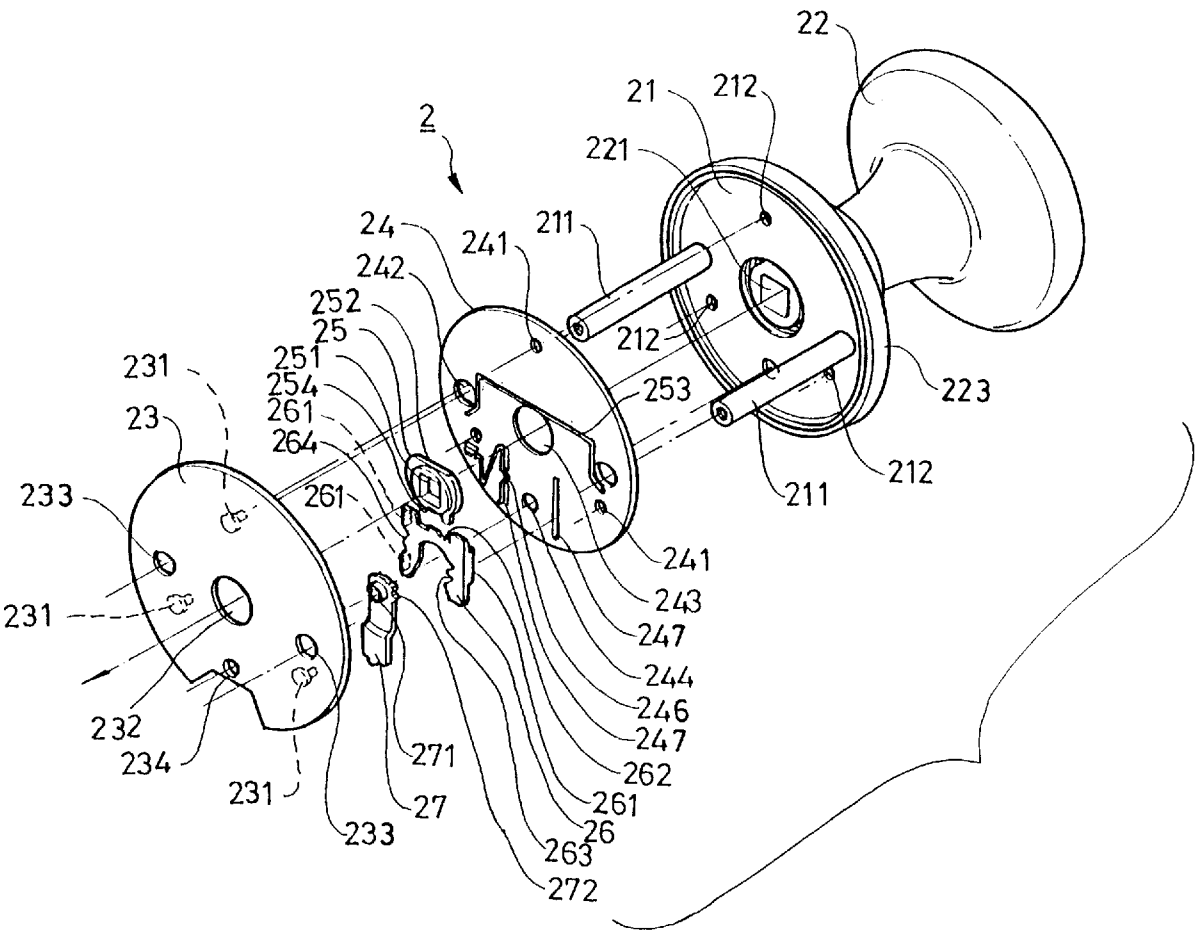
FIG. 2 is an exploded perspective view of an outer handle assembly in accordance with the present invention.
Figure 3:
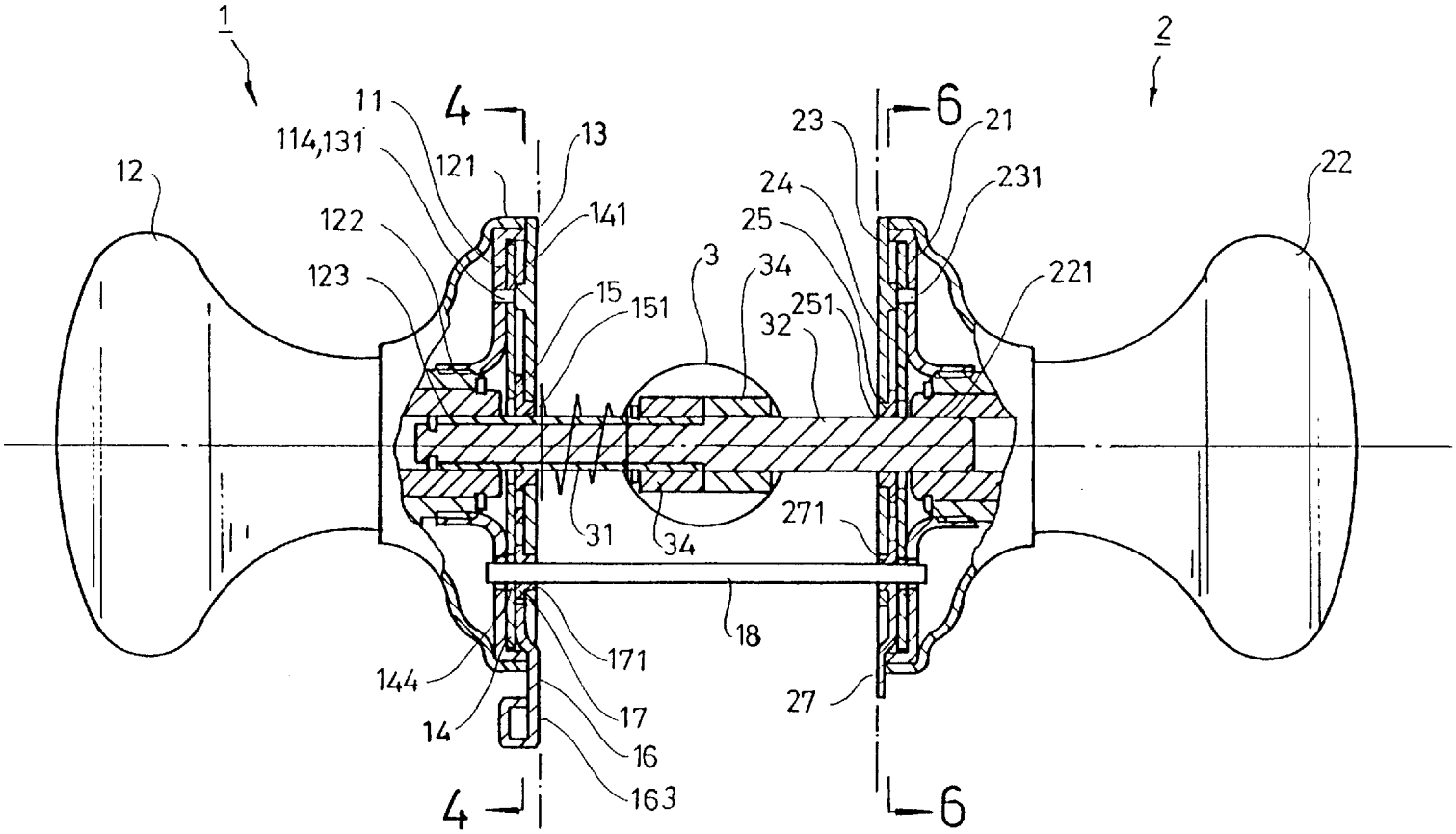
FIG. 3 is a side elevational view, partly sectioned, of the lock assembly in accordance with the present invention.

Referring to the drawings and initially to FIGS. 1 to 3, a lock assembly in accordance with the present invention generally comprises an inner handle assembly 1, an outer handle assembly 2, and a latch assembly 3. As shown in FIGS. 1 and 3, the inner handle assembly 1 includes a base plate 11, a handle 12, a protective plate 13, a mounting plate 14, a returning piece 15, a control plate 16, a linking plate 17, and a linking rod 18. The base plate 11 is mounted to an inner side of a door plate by means of extending fasteners, e.g., bolts 112 through holes 111 defined therein. The handle 12 includes a knob portion to grasp and a threaded end 122 to engage with a screw hole 113 defined in the base plate 11. An outer cover 121 is mounted to the threaded end 122 and allows rotation relative to the outer cover 121.

The protective plate 13 includes a plurality of stubs 131 formed on one side thereof to extend through holes 141 defined in the mounting plate 14 and holes 114 defined in the base plate 11, thereby mounting the mounting plate 14 to the base plate 11. The protective plate 13 further includes a central hole 132 through which an axle rod 31 extends, a hole 134 through which the linking rod 18 extends and two positioning holes 133 through which the bolts 112 extend. Thus, the protective plate 13 is mounted to the inner side of the door plate to provide a protection, as shown in FIG. 3.

The mounting plate 14 includes a pair of holes 142 through which the bolts 112 extend, a central hole 143 through which the axle rod 31 extends, and a hole 144 through which the linking rod 18 extends. The mounting plate 14 further includes a mounting hole 145 for securely receiving an end of an elastic member 146 the other end of which is attached to the control plate 16. The mounting plate 14 further includes two sets of slots 147 for receiving guiding blocks 161 on the control plate 16, thereby making the control plate 16 move rectilinearly.

The returning plate 15 includes a non-circular axle hole 151 through which the axle rod 31 extends so as to rotate with the axle rod 31 together. The returning plate 15 further includes a rectilinear side 152 to releasably engage with a top side 162 (preferably rectilinear) of the control plate 16. When the control plate 16 moves upwardly, the top side 162 may be engaged with the rectilinear side 152 of the returning plate 15, and when the control plate 16 moves downwardly, the top side 162 disengages from the rectilinear side 152. The control plate 16 includes a grasp section 163 for easy grasp. The control plate 16 further includes two notches 164 in a lateral side thereof to engage with the elastic member 146 for positioning purpose. The control plate 16 further includes a slot 165 in which a periphery defining the slot 165 has a toothed structure 166 for engaging with a toothed structure 172 of the linking plate 17, such that the linking plate 17 rotates when the control plate 16 moves vertically. The linking plate 17 also includes a non-circular axle hole 171 through which the linking rod 18 extends. The linking plate 17 is mounted in the slot 165 of the control plate 16. When the linking plate 17 rotates, the linking rod 18 also rotates. It is appreciated that linking rod 18 is of a non-circular section and is fittingly extended through the axle hole 171 of the linking plate 17 and an axle hole 271 of a latching plate 27 of the outer handle assembly 2, which will be described later.

Referring to FIG. 2, the outer handle assembly 2 includes a base plate 21, a handle 22, a protective plate 23, a mounting plate 24, a restraining piece 25, a control plate 26, and a latching plate 27. The bolts 112 are extended through two posts 211 on the base plate 21 so as to mount the base plate 21 to an outer side of the door plate. The handle 22 includes a knob portion to grasp and a non-circular axle hole 221 for receiving an end of an axle rod 32. An outer cover 223 is mounted around the base plate 21 to provide a protection.

The protective plate 23 includes a plurality of stubs 231 formed on one side thereof to extend through holes 241 defined in the mounting plate 24 and holes 212 defined in the base plate 21, thereby mounting the mounting plate 24 to the base plate 21. The protective plate 23 further includes a central hole 232 through which the axle rod 32 extends, a hole 234 through which the linking rod 18 extends and two positioning holes 233 through which the bolts 112 extend. Thus, the protective plate 23 is mounted to the outer side of the door plate to provide a protection, as shown in FIG. 3.

The mounting plate 24 includes a pair of holes 242 through which the bolts 112 extend, a central hole 243 through which the axle rod 32 extends, and a hole 244 through which the linking rod 18 extends. An elastic member 246 has a first end securely attached to the mounting plate 24 and a second end securely attached to the control plate 26. The mounting plate 24 further includes two sets of slots 247 for receiving guiding blocks 261 on the control plate 26, thereby making the control plate 26 move rectilinearly.

The restraining plate 25 includes a non-circular axle hole 251 through which the axle rod 32 extends so as to rotate with the axle rod 32 together. The restraining plate 25 further includes a rectilinear section 252 in a top side thereof to releasably engage with a top side 262 (preferably rectilinear) of the control plate 26. The restraining plate 25 cannot be rotated under normal status since rectilinear section 252 is biased by a rectilinear elastic member 253. The elastic member 253 includes two ends respectively attached to the posts 211 to provide the positioning effect. The restraining plate 25 further includes a toothed structure 254 which may releasably engage with a toothed structure 262 of the control plate 26 to position the restraining plate 25, which, in turn, restrains rotational movements of the handle 22 and the axle rod 32. The control plate 26 further includes two notches 264 in a lateral side thereof to engage with the elastic member 246 for positioning purpose. The control plate 16 further includes a second toothed structure 263 for engaging with a toothed structure 272 of the latching plate 27. The latching plate 27 also includes a non-circular axle hole 271 through which the linking rod 18 extends. The latching plate 27 further includes an extension handle (not labeled) for the user's grasp. Rotation of the extension handle or the linking rod 18 causes rotation of the latching plate 27, which, in turn, causes the control plate 26 to move upwardly or downwardly.

Referring to FIG. 1, the latching assembly 3 includes two wheels 34 which respectively engage with and thus rotated by the axle rod 31 and the axle rod 32 to retract a latch 35, which is conventional and therefore not further described.

Figure 4:
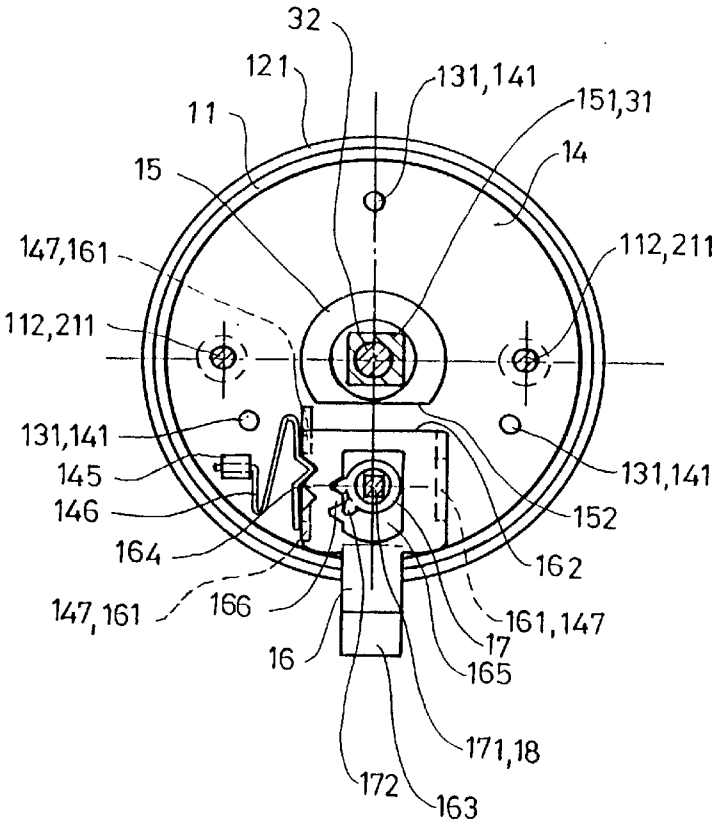
FIG. 4 is a cross sectional view taken along line 4—4 in FIG. 3.
Figure 6:
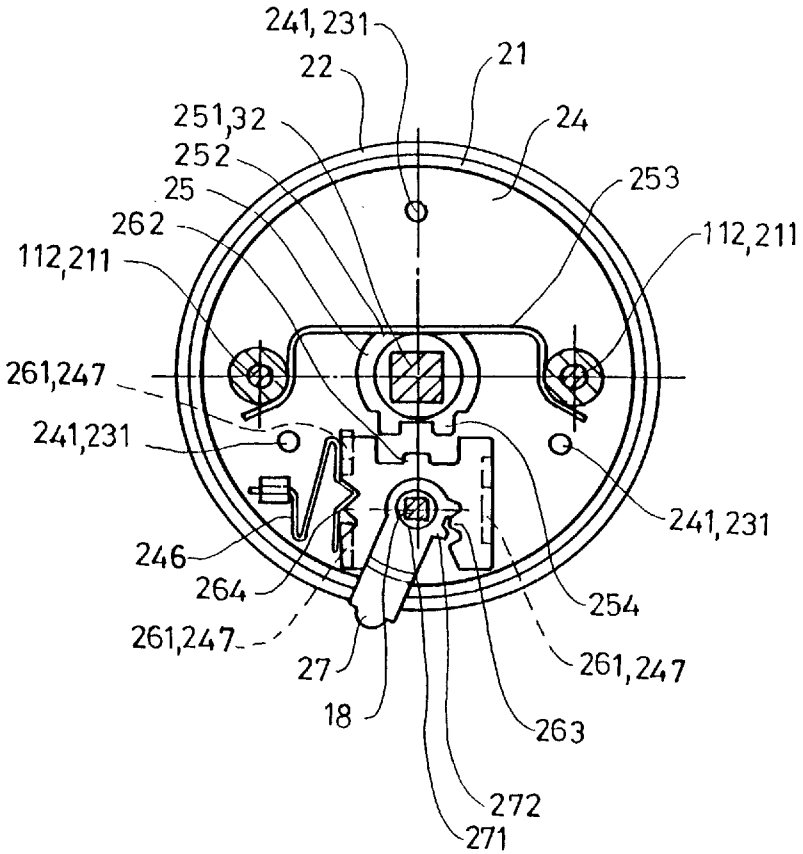
FIG. 6 is a cross sectional view taken along line 6—6 in FIG. 3.

Referring to FIG. 4, the inner handle assembly is in an unlocked status in which the control plate 16 is in a relatively lower position and is positioned by the elastic member 146. The control plate 26 of the outer handle assembly 2 is also in a relatively lower position, as shown in FIG. 6. Either handle 12, 22 may be rotated as the handle axles 31 and 32 are both rotatable.

Figure 5:
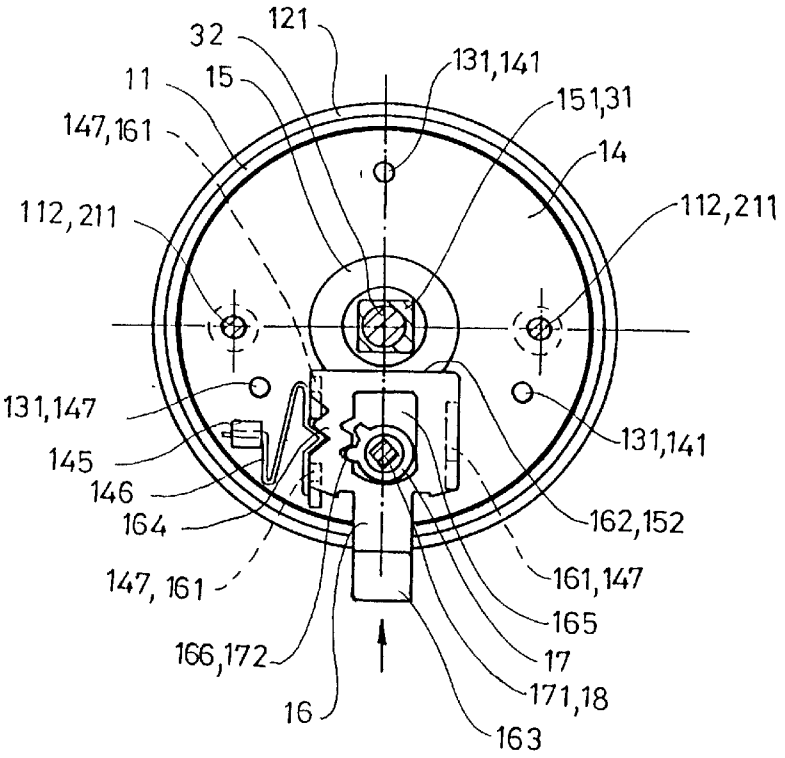
FIG. 5 is a sectional view similar to FIG. 4, in which the lock assembly is in a locked status.
Figure 7:
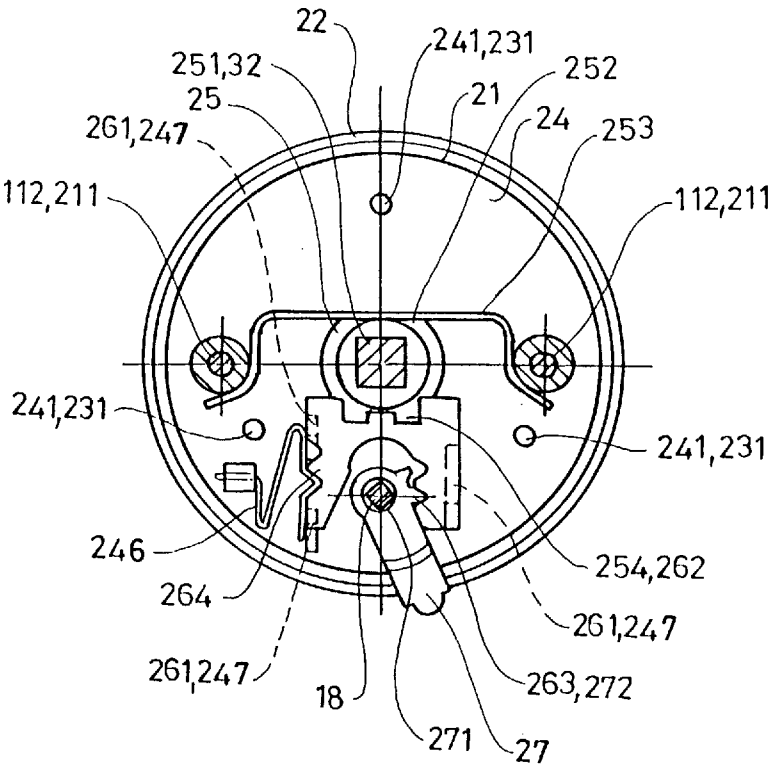
FIG. 7 is a sectional view similar to FIG. 6, in which the lock assembly is in a locked status.

Referring to FIG. 5, the inner handle assembly 1 is in a latched status in which the control plate 16 is manually shifted to a relatively higher position and is positioned by the elastic member 146. Since upward movement of the toothed structure 166 of the control plate 16 causes the linking plate 17 to rotate, the linking rod 18 may actuate the latching plate 27 of the outer handle assembly 2 to rotate (FIG. 7). Accordingly, the toothed structure 272 of the latching plate 27 urges the control plate 26 to move upwardly such that the toothed structure 262 of the control plate 26 engages with the toothed structure 254 of the restraining plate 25, thereby preventing rotation of the restraining plate 25. And the axle rod 32 and the outer handle 22 are thus not rotatable, i.e., the lock assembly is in a latched status.

When in emergency, the user may rotate the latching plate 27, e.g., clockwise (see FIG. 7) which may cause the restraining plate 26 to move downwardly, thereby disengaging the toothed structure 262 from the toothed structure 254. Thus, the restraining plate 25 may be rotated under rotation of the handle 22 via actuation of the axle rod 32, thereby retracting the latch 33 of the latch assembly 3 to allow opening of the door.

Figure 8:
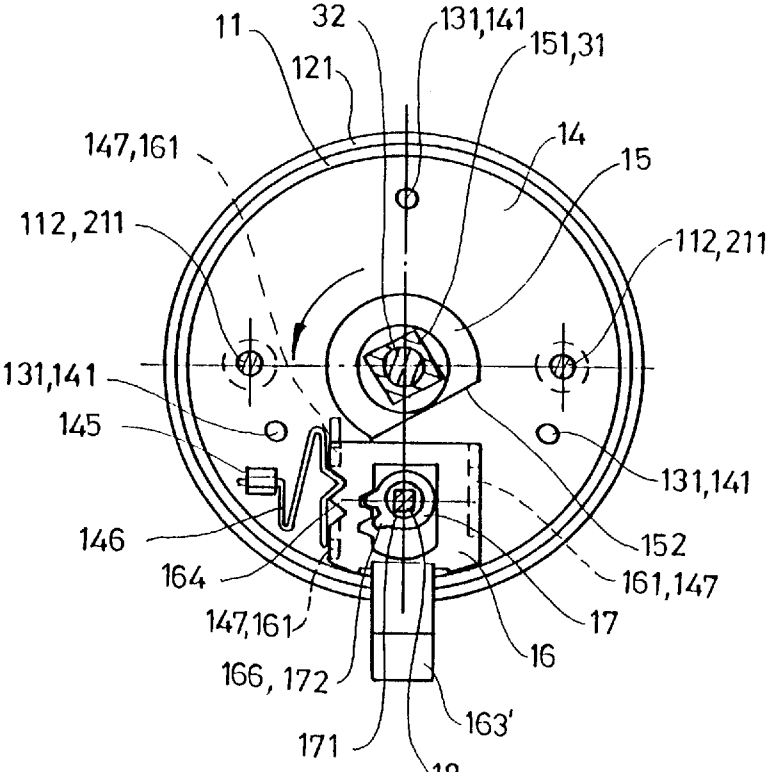
FIG. 8 is a sectional view illustrating rotation of the inner handle.

Referring to FIG. 8, when in a latched status and if the inner handle 12 is rotated, the axle rod 31 is also rotated, which causes rotation of the returning plate 15 to retract the latch 33. At the same time, the rectilinear side 152 of the returning plate 15 urges the control plate 16 to move downwardly, which, in turn, causes rotation of the linking plate 17 and the linking rod 18. Rotation of the linking rod 18 causes rotation of the latching plate 27 of the outer handle assembly, which, in turn, causes the control plate 26 to move downwardly, thereby also unlatching the outer handle assembly.

Figure 9:
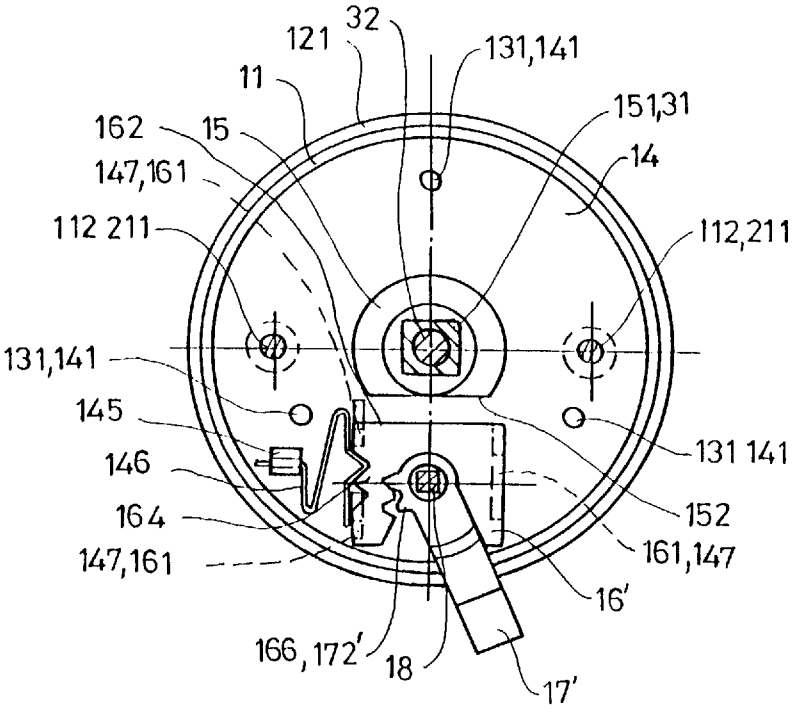
FIG. 9 is a sectional view illustrating a modified embodiment of the lock assembly in accordance with the present invention.

FIG. 9 illustrates a modified embodiment of the invention, in which the linking plate 17' may have a larger extension handle section to control vertical movement of the control plate 16 upon clockwise and counterclockwise movement of the extension handle section. Similarly, the control plate 26 of the outer handle assembly 2 can be moved downwardly or upwardly upon similar arrangement in the structure.

By such an arrangement, it is appreciated that the lock assembly can be unlatched from outside when in emergency, especially in the case that one falls in the bathroom or other emergent situations.

Although the invention has been explained in relation to its preferred embodiment, it is to be understood that many other possible modifications and variations can be made without departing from the spirit and scope of the invention as hereinafter claimed.

What is claimed is:

1. A lock assembly, comprising:

an inner handle assembly comprising:

a first base plate (11) adapted to be secured to an inner side of a door plate, a first handle (12) mounted to the first base plate (11) to rotate therewith, a first mounting plate (14) secured to the first base plate (11) and including a first slot means (147) defined therein, a returning plate (15), a first control plate (16) slidably engaged with the first slot means (147) of the first mounting plate (14) and including a first toothed structure (166), a linking plate (17) mounted to the first control plate (16) and including a second toothed structure (172) to engage with the first toothed structure (166), wherein rotational movement of the linking plate (17) along the first slot means (147) causes rectilinear movement of the first control plate (16) and wherein rectilinear movement of the first control plate (16) along the first slot means (147) causes rotational movement of the linking plate (17), thereby causing the first control plate (16) to move between a first latched position which engages with the returning plate (15) and a second unlatched position which disengages from the returning plate (15), a first axle rod (31) extended through the returning plate (15), the first mounting plate (14), and the first base plate (11) to rotate therewith and including a first end secured to the first handle (12) to rotate therewith and a second end, an outer handle assembly comprising:

a second base plate (21) adapted to be secured to an outer side of the door plate, a second handle (22) mounted to the second base plate (21) to rotate therewith, a second mounting plate (24) secured to the second base plate (21) and including a second slot means (247) defined therein, a restraining plate (25) including a third toothed structure (254), a second control plate (26) slidably engaged with the second slot means (247) of the second mounting plate (24) and including a fourth toothed structure (262) to releasably engage with the third toothed structure (254) and a fifth tooted structure (263), a latching plate (27) including a first end mounted to the second control plate (26) and including a sixth toothed structure (272) to engage with the fifth toothed structure (263) and a second operative end, wherein rotational movement of the latching plate (27) causes rectilinear movement of the second control plate (26), thereby causing the second control plate (26) to move between a first latched position in which the third toothed structure (254) engages with the fourth toothed structure (262) to prevent rotational movement of the restraining plate (25) and a second unlatched position in which the third toothed structure (254) disengages from the fourth toothed structure (262) to allow rotational movement of the restraining plate (25), a second axle rod (32) extended through the restraining plate (25), the second mounting plate (24), and the second base plate (21) to rotate therewith and including a first end secured to the second handle (22) to rotate therewith and a second end connected to the second end of the first axle rod, a latch assembly (3) including a latch (35) actuatable upon rotation of the first axle rod (31) and the second axle rod (32), and a linking rod (18) extended through the linking plate (17), the first mounting plate (14), the first base plate (14), the latching assembly (3), the latching plate (27), the second mounting plate (24), and the second base plate (21) to rotate therewith, whereby when the first control plate (16) is moved from the first latched position to the second unlatched position thereof, the second control plate (26) is moved to the second unlatched position thereof and the second handle (22) is not rotatable, and when either one of the first handle (12) and the latching plate (27) is rotated, the first control plate (16) and the second control plate (26) are moved to the first latched positions thereof.

2. The lock assembly according to claim 1, wherein each of the first control plate (16) and the second control plate (26) includes two notches (164, 264) defined in a lateral sides thereof, and further includes an elastic means (146, 246) having a first end securely attached to the associated control plate (16, 26) and a second end engaged in one of the two notches (164, 264) to retain the control plate (16, 26) in position.

3. The lock assembly according to claim 1, wherein the first control plate (16) of the inner handle assembly (1) includes a grasp section (163) for user's grasp to move between the first latched position and the second unlatched position thereof.

4. The lock assembly according to claim 1, wherein the returning plate (15) includes a rectilinear side to engage with the first control plate (16).

5. The lock assembly according to claim 1, wherein the restraining plate (25) includes a rectilinear section (252) to engage with the second control plate (26).

* * * * *